US007648228B2

(12) United States Patent
Kojima

(10) Patent No.: US 7,648,228 B2
(45) Date of Patent: Jan. 19, 2010

(54) LIQUID EJECTION HEAD, LIQUID EJECTION APPARATUS AND IMAGE FORMING APPARATUS

(75) Inventor: Toshiya Kojima, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 354 days.

(21) Appl. No.: 11/826,962

(22) Filed: Jul. 19, 2007

(65) Prior Publication Data

US 2008/0018679 A1 Jan. 24, 2008

(30) Foreign Application Priority Data

Jul. 21, 2006 (JP) ..... 2006-199544

(51) Int. Cl.
*B41J 2/045* (2006.01)

(52) U.S. Cl. ..... 347/68

(58) Field of Classification Search ..... 347/68, 347/69–72, 47, 54–55, 61; 400/124.16, 124.17; 310/363–366; 29/25.35
See application file for complete search history.

(56) References Cited

U.S. PATENT DOCUMENTS 6,347,859 B1 2/2002 Kawakami et al.
2006/0209129 A1* 9/2006 Onozawa ..... 347/55
2008/0129798 A1* 6/2008 Wee et al. ..... 347/68

FOREIGN PATENT DOCUMENTS

JP 6-226985 A 8/1994
JP 2000-127387 A 5/2000
JP 2001-18390 A 1/2001

* cited by examiner

*Primary Examiner*—K. Feggins
(74) *Attorney, Agent, or Firm*—Birch, Stewart, Kolasch & Birch, LLP

(57) ABSTRACT

The liquid ejection head includes: a plurality of nozzles having openings through which liquid is ejected; a plurality of pressure chambers which are connected to the nozzles, respectively; a space section forming member which defines a plurality of space sections arranged adjacently to the openings of the nozzles, respectively; and a liquid transmission hole forming member which is formed with a plurality of liquid transmission holes in coaxial positions with respect to the nozzles so as to oppose the openings of the nozzles across the space sections, respectively, wherein in terms of cross-sectional areas parallel to a plane including the openings of the nozzles, each of the space sections is smaller than each of the pressure chambers, and larger than each of the openings of the nozzles and the liquid transmission holes.

7 Claims, 14 Drawing Sheets

LIQUID EJECTION HEAD, LIQUID EJECTION APPARATUS AND IMAGE FORMING APPARATUS

BACKGROUND OF THE INVENTION

1. Field of the Invention

The present invention relates to a liquid ejection head, a liquid ejection apparatus and an image forming apparatus, and more particularly, to technology for preventing ejection defects caused by increased viscosity of the ink inside nozzles.

2. Description of the Related Art

An inkjet recording apparatus records a desired image on a recording medium by ejecting ink droplets selectively from nozzles in a recording head, while moving the recording head having the nozzles relatively with respect to the recording medium. Recording apparatuses of this kind are broadly divided into line type apparatuses and serial type apparatuses. The line type apparatuses carry out recording simply by moving a recording medium and a long recording head (line head) having substantially the same width as the recording medium, relatively to each other, in the paper conveyance direction (sub-scanning direction), and the serial type apparatuses carry out recording by moving a short recording head (shuttle head) back and forth reciprocally in the breadthways direction of the recording medium (main scanning direction). Furthermore, the ink ejection method may be, for example, a piezoelectric method, which ejects ink droplets from a nozzle by using the displacement of a piezoelectric element to pressurize the ink in a pressure chamber, or a thermal method, which generates bubbles inside a pressure chamber by means of the thermal energy produced by a heating element, such as a heater, an ink droplet being ejected from a nozzle due to the pressure generated by these bubbles.

In an inkjet recording apparatus of this kind, if variations arise in the volume, flight speed, flight direction, or the like, of the ink droplets ejected from the nozzles and ejection becomes instable, then this may lead to deterioration of the image quality. Hence, in order to improve the image quality, it is extremely important that ink droplets can be ejected in a stable state at all times from the nozzles.

Possible examples of factors which cause ejection instabilities are contact between the recording medium and the nozzle surface of the recording head, and adherence of foreign material such as dust, dirt, ink droplets, or the like, to the nozzle surface. Therefore, in order to protect the nozzle surface, for example, in Japanese Patent Application Publication No. 2001-018390, a nozzle protection plate formed with slit-shaped openings that are to be ink ejection channels is provided at a prescribed interval from the nozzle surface.

Another factor which causes ejection instabilities is drying or increase in the viscosity of the ink inside the nozzles when ink is not ejected. Therefore, in order to prevent ejection defects due to increased viscosity of the ink, for example, in Japanese Patent Application Publication No. 06-226985, a cap member is placed in close contact with the nozzle surface, and in Japanese Patent Application Publication No. 2000-127387, the nozzles are closed off with a sealing liquid.

However, in Japanese Patent Application Publication No. 2001-018390, in addition to protecting the nozzle surface from contact or impacts with the recording medium, or adherence of foreign material, or the like, it is also sought to prevent ink droplets from collecting on the nozzle protection plate or the nozzle surface by designing the shape of the openings in order that the ink droplets can pass through same, but no consideration is given to the evaporation of the ink solvent from the interior of the nozzles though these openings. Consequently, there is a problem in that although the nozzle surface can be protected, it is not possible to prevent ejection defects due to increased viscosity of the ink.

In Japanese Patent Application Publication No. 06-226985, a serial type of inkjet recording apparatus is used and when the apparatus has changed from a recording state to a non-recording state, the recording head is moved to a non-recording region, and the cap member disposed in that region is moved and placed in close contact with the nozzle surface of the recording head. However, if it is sought to apply a composition of this kind to a line type of inkjet recording apparatus, this leads to increased size of the apparatus and increased costs, in addition to which a long time is required until the cap member is placed in close contact with the nozzle surface, and evaporation of the ink solvent progresses during this time. Moreover, even after the cap member has been placed in close contact with the nozzle surface, there is also a risk that evaporation of the ink solvent will continue until the sealed air enclosed by the cap member reaches a state saturated with the evaporated ink solvent. In this way, it takes a long time to restrict the progress of the evaporation of the ink solvent inside the nozzles, and therefore ejection defects may arise as a result of increased ink viscosity. Consequently, when recording is restarted, it becomes necessary to remove the ink of increased viscosity inside the nozzles by suctioning or preliminary ejection (also called purging or spit ejection), and hence a large amount of ink is consumed wastefully.

In Japanese Patent Application Publication No. 2000-127387, a composition for supplying the sealing liquid is required, and this leads to increased size of the apparatus and increased costs. Moreover, since the sealing liquid is a liquid that is different to the ink components, then when the sealing liquid is removed before restarting recording, the ink must also be removed at the same time, leading to a problem in that a large amount of ink is consumed wastefully

SUMMARY OF THE INVENTION

The present invention has been contrived in view of these circumstances, an object thereof being to provide a liquid ejection head, a liquid ejection apparatus and an image forming apparatus which protects the nozzle surface, while also preventing ejection defects caused by increase in the viscosity of the ink and reducing wasteful consumption of liquid, as well as being able to achieve size reduction and cost reduction in the apparatus.

In order to attain the aforementioned object, the present invention is directed to a liquid ejection head, comprising: a plurality of nozzles having openings through which liquid is ejected; a plurality of pressure chambers which are connected to the nozzles, respectively; a space section forming member which defines a plurality of space sections arranged adjacently to the openings of the nozzles, respectively; and a liquid transmission hole forming member which is formed with a plurality of liquid transmission holes in coaxial positions with respect to the nozzles so as to oppose the openings of the nozzles across the space sections, respectively, wherein in terms of cross-sectional areas parallel to a plane including the openings of the nozzles, each of the space sections is smaller than each of the pressure chambers, and larger than each of the openings of the nozzles and the liquid transmission holes.

According to this aspect of the present invention, by adopting a composition in which the space sections are provided respectively at the nozzles on the liquid ejection side of the nozzles, the liquid transmission holes are provided respectively at positions opposing the nozzles across the space sections (positions coaxial with respect to the nozzles), and the cross-sectional areas of the parts (nozzles, space sections, liquid transmission holes, pressure chambers) parallel to the plane including the openings of the nozzles (nozzle surface) have the relationships stated above, then it is possible to protect the nozzle surface from adherence of foreign matter and contact with the recording medium, or the like, as well as being able to prevent ejection defects caused by increased viscosity of the liquid and to reduce wasteful consumption of the liquid. Furthermore, it is possible to eject the liquid and to prevent increase in viscosity, while in a state where the space sections and the liquid transmission holes are disposed on the liquid ejection side of the nozzles, and hence the objects can be achieved by means of a simple composition without requiring the provision of special mechanisms, thus making it possible to reduce the size and the cost of the apparatus.

Preferably, each of the liquid transmission holes is smaller than each of the openings of the nozzles, in terms of the cross-sectional areas parallel to the plane including the openings of the nozzles.

According to this aspect of the present invention, the cross-sectional area of the liquid transmission hole is formed so as to be smaller than the cross-sectional area of the nozzle. Since the space section is closer to a sealed state, then the interior thereof is more liable to reach a state saturated with the evaporated liquid and the progress of the evaporation of liquid inside the nozzle can be suppressed reliably.

In order to attain the aforementioned object, the present invention is also directed to a liquid ejection apparatus, comprising: the above-described liquid ejection head; and a control device which changes a position of a free surface of the liquid at each of the nozzles in accordance with an operational state of the liquid ejection head.

According to this aspect of the present invention, it is possible to rapidly suppress the progress of liquid evaporation, by changing the position of the liquid surface in accordance with the operational state of the liquid ejection head.

Preferably, the control device sets the position of the free surface of the liquid to be a position within each of the space sections when the liquid ejection head is in a non-recording state, and sets the position of the free surface of the liquid to be a position nearby each of the openings of the nozzles when the liquid ejection head is in a recording state.

According to this aspect of the present invention, when the position of the liquid surface is changed in accordance with the operational state of the liquid ejection head, the position of the liquid surface is set to the position within the space section when the liquid ejection head is in a non-recording state, and the position of the liquid surface is set to the position in the vicinity of the nozzle opening when the liquid ejection head is in a recording state.

Preferably, a contact angle of the liquid with respect to an inner wall of each of the space sections is greater than a contact angle of the liquid with respect to an inner wall of each of the nozzles.

According to this aspect of the present invention, by providing a surface treatment in such a manner that this relationship is satisfied, it is possible to achieve stable ejection without the liquid inside the nozzles leaking out onto the surface of the nozzle openings (nozzle surface).

In order to attain the aforementioned object, the present invention is also directed to an image forming apparatus comprising at least one of the above-described liquid ejection head and the above-described liquid ejection apparatus.

According to this aspect of the present invention, it is possible to reduce the size and the cost of the image forming apparatus, as well as being able to improve image quality.

According to the present invention, by adopting a composition in which space sections are provided respectively at nozzles on the liquid ejection side of the nozzles, liquid transmission holes are provided respectively at positions opposing the nozzles across the space sections, and the cross-sectional areas of the parts (the nozzles, space sections, liquid transmission holes, and pressure chambers) parallel to the surface of the openings of the nozzles (nozzle surface) have the relationships stated above, then it is possible to protect the nozzle surface from adherence of foreign matter and contact with the recording medium, or the like, as well as being able to prevent ejection defects caused by increased viscosity of the liquid and to reduce wasteful consumption of the liquid. Furthermore, it is possible to eject liquid and to prevent increase in viscosity, while in a state where the space sections and the liquid transmission holes are disposed on the liquid ejection side of the nozzles, and hence the objects can be achieved by means of a simple composition without requiring the provision of special mechanisms, thus making it possible to reduce the size and the cost of the apparatus.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

Figure 1:
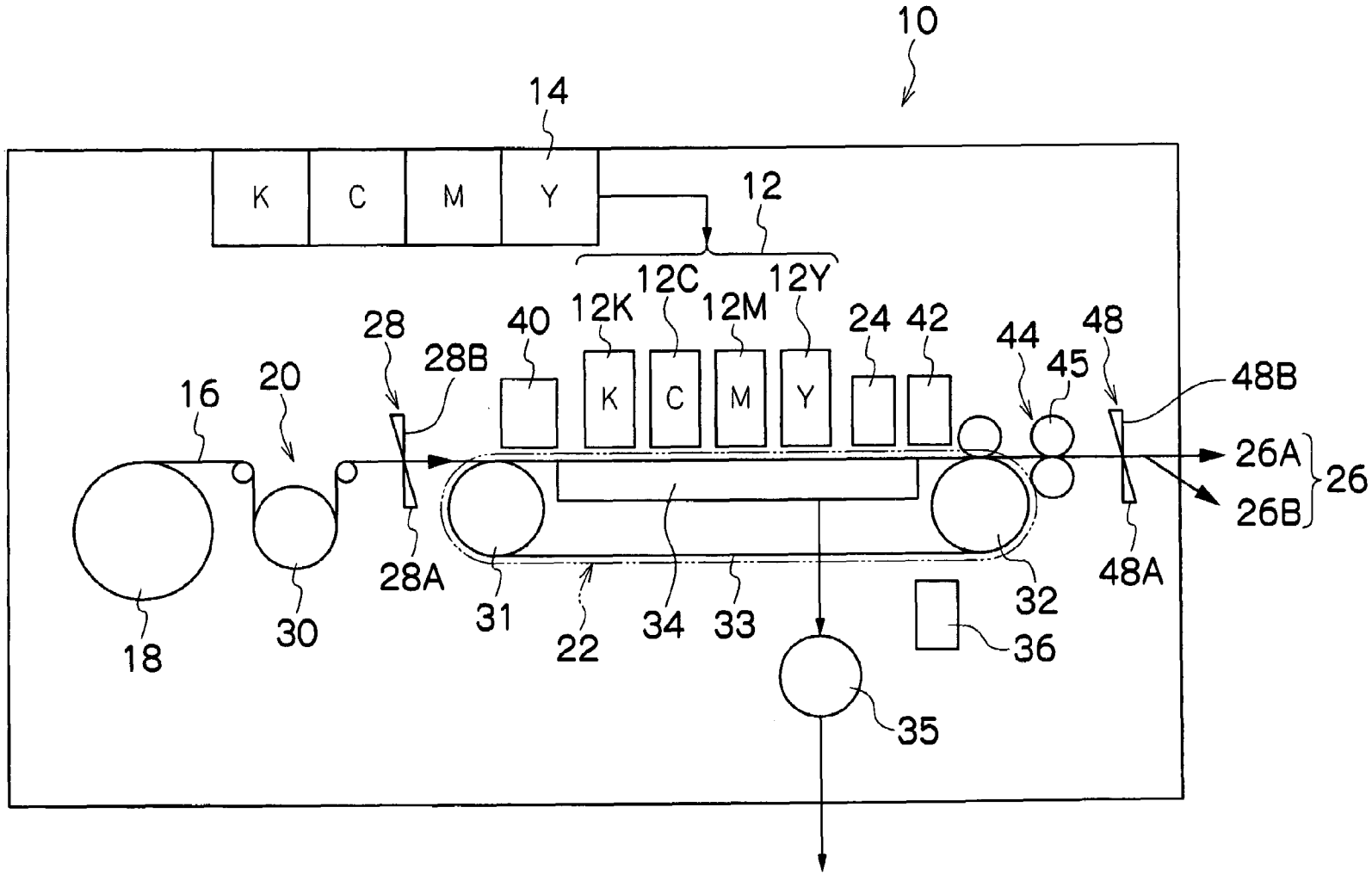
FIG. 1 is a general schematic drawing showing a general view of an inkjet recording apparatus according to an embodiment of the present invention.

Firstly, the composition of an inkjet recording apparatus according to a first embodiment of the present invention is described. FIG. 1 is a general schematic drawing showing an approximate general view of the inkjet recording apparatus 10. As shown in FIG. 1, the inkjet recording apparatus 10 includes: a print unit 12 having a plurality of recording heads 12K, 12C, 12M, and 12Y for inks of colors black (K), cyan (C), magenta (M), and yellow (Y), respectively; an ink storing and loading unit 14, which stores the inks of K, C, M and Y to be supplied to the recording heads 12K, 12C, 12M, and 12Y, a paper supply unit 18, which supplies recording paper 16; a decurling unit 20, which removes curl in the recording paper 16; a suction belt conveyance unit 22, which is disposed facing the ejection surface of the print unit 12 and conveys the recording paper 16 while keeping the recording paper 16 flat; a print determination unit 24, which reads the printed result produced by the print unit 12; and a paper output unit 26, which outputs image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the ejection surface of the printing unit 12 and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the ejection surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction. The belt 33 is driven in the clockwise direction in FIG. 1 by the motive force of a motor (not illustrated) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print unit 12 is a so-called "full line head" in which a line head having a length corresponding to the maximum paper width is arranged in a direction (main scanning direction) that is perpendicular to the paper conveyance direction (sub-scanning direction). The recording heads 12K, 12C, 12M and 12Y forming the print unit 12 are constituted by line heads in which a plurality of ink ejection ports (nozzles) are arranged through a length exceeding at least one edge of the maximum size recording paper 16 intended for use with the inkjet recording apparatus 10.

The recording heads 12K, 12C, 12M, and 12Y are arranged in the order of black (K), cyan (C), magenta (M), and yellow (Y) from the upstream side (the left-hand side in FIG. 1), along the conveyance direction of the recording paper 16 (paper conveyance direction). A color image can be formed on the recording paper 16 by ejecting the inks from the recording heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the conveyance direction (the sub-scanning direction) just once (in other words, by means of a single sub-scan). Higher-speed printing is thereby made possible and productivity can be improved in comparison with a shuttle type head configuration in which a recording head moves reciprocally in a direction (main-scanning direction) that is perpendicular to paper conveyance direction.

Although a configuration with the four standard colors, K M C and Y, is described in the present embodiment, the combinations of the ink colors and the number of colors are not limited to these, and light and/or dark inks can be added as required. For example, a configuration is possible in which recording heads for ejecting light-colored inks such as light cyan and light magenta are added.

As shown in FIG. 1, the ink storing and loading unit 14 has ink tanks for storing the inks of the colors corresponding to the respective recording heads 12K, 12C, 12M, and 12Y, and the respective tanks are connected to the recording heads 12K, 12C, 12M, and 12Y by means of channels (not shown). The ink storing and loading unit 14 has a warning device (e.g., a display device, an alarm sound generator, or the like) for warning when the remaining amount of any ink is low, and has a mechanism for preventing loading errors among the colors.

The print determination unit 24 has an image sensor (e.g., a line sensor, or the like) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the recording heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the recording heads 12K, 12C, 12M, and 12Y for the respective colors, and the ejection of each recording head is determined. The ejection determination includes the presence or absence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not illustrated, the paper output unit 26A for the target prints is provided with a sorter for collecting prints according to print orders.

Next, the configuration of the recording head is described. The recording heads 12K, 12M, 12C, and 12Y of the respective ink colors have the same structure, and a reference numeral 50 is hereinafter designated to any of the recording heads.

Figure 2:
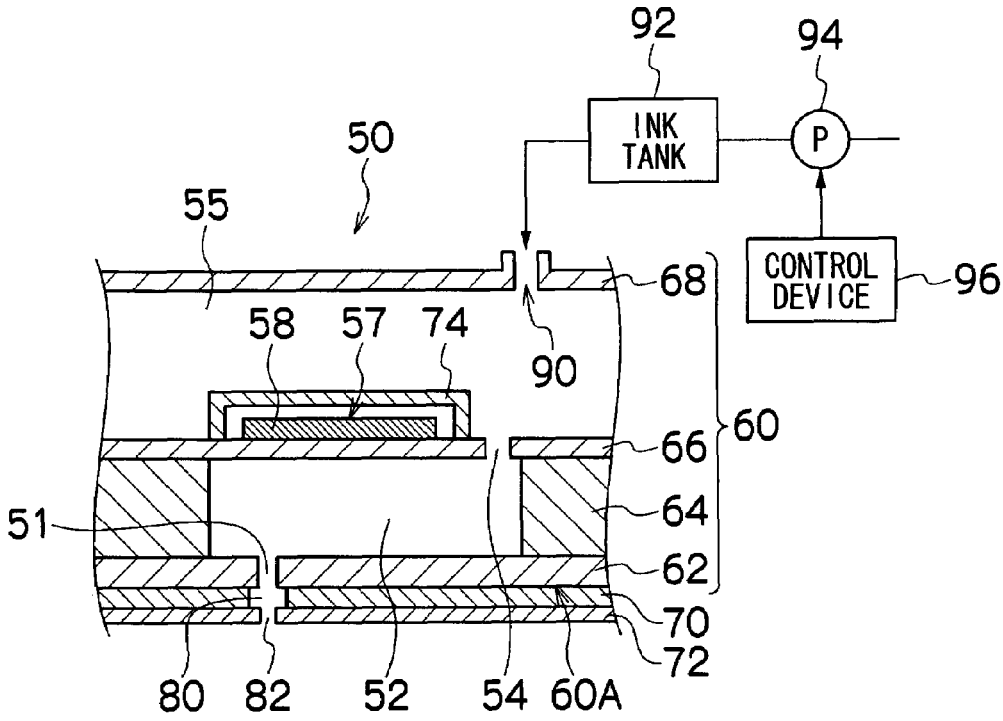
FIG. 2 is a cross-sectional diagram showing a portion of a recording head in the inkjet recording apparatus.

FIG. 2 is a cross-sectional diagram showing a portion of a recording head 50. As shown in FIG. 2, the recording head 50 is constituted of a head main body 60 laminated from a nozzle plate 62, a pressure chamber forming member 64, a diaphragm 66 and a common flow channel forming member 68, and a spacer member 70 and a nozzle protection member 72, which are disposed on a nozzle surface 60A of the head main body 60.

Figure 3:
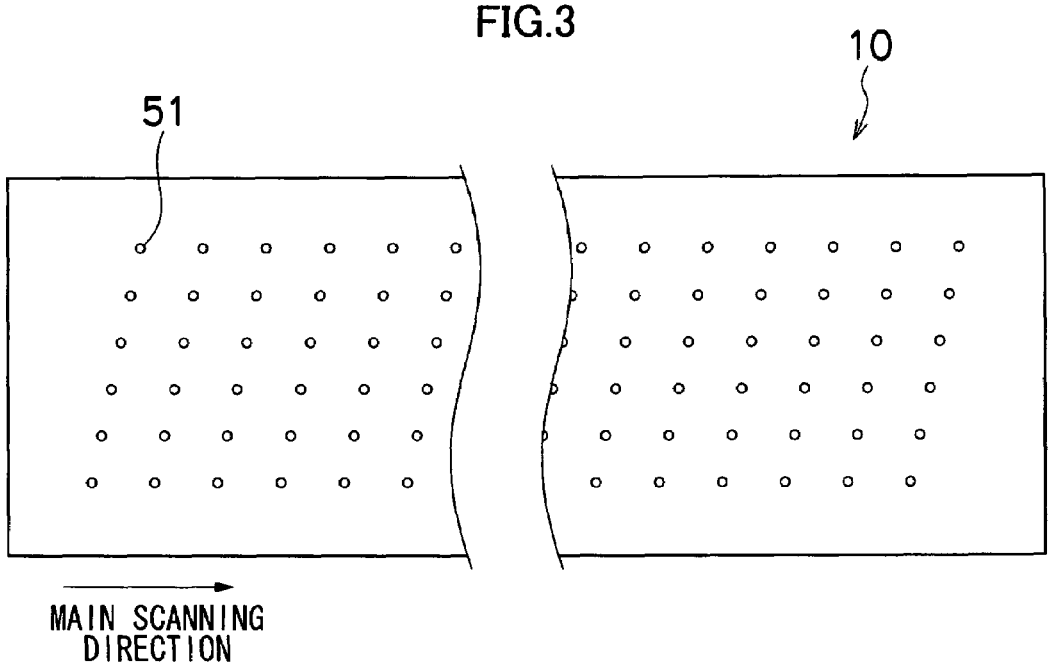
FIG. 3 is a plan diagram of a nozzle plate of the recoding head.

A plurality of nozzles (nozzle holes) 51 for ejecting ink droplets are formed in the nozzle plate 62, which constitutes the nozzle surface 60A of the head main body 60. As shown in the plan diagram of the nozzle plate 62 in FIG. 3, the nozzles 51 are arranged in a two-dimensional configuration (matrix configuration) following a main scanning direction, which corresponds to the lengthwise direction of the nozzle plate 62, and an oblique direction, which is not perpendicular to the main scanning direction. In this way, a nozzle arrangement of high density is achieved.

Pressure chambers (pressure chamber holes) 52 corresponding respectively to the nozzles 51 are formed in the pressure chamber forming member 64, and each nozzle 51 is connected to one end of each pressure chamber 52 (the lower end in FIG. 2). Ink to be ejected from the nozzle 51 is filled in the pressure chamber 52. In the present embodiment, the pressure chamber forming member 64 is bonded on the nozzle plate 62, and the nozzles 51 are connected directly to the pressure chambers 52, but the implementation of the present invention is not limited to a composition of this kind. For example, it is also possible to adopt a composition in which a flow channel forming member is interposed between the nozzle plate 62 and the pressure chamber forming member 64, in such a manner that the nozzles 51 and the pressure chambers 52 are indirectly connected through flow channels.

An upper wall surface of the pressure chambers 52 is constituted of the diaphragm 66, and a common flow channel 55 is disposed on a side of the diaphragm 66 reverse to the side adjacent to the pressure chambers 52. Partitions (upper wall and side wall) of the common flow channel 55 are constituted of the common flow channel forming member 68. The lower wall of the common flow channel 55 is constituted of the diaphragm 56. The ink to be supplied to the pressure chambers 52 is collected in the common flow channel 55. Supply flow channels (supply holes) 54 are formed in the diaphragm 56 at positions corresponding respectively to the pressure chambers 52, and the pressure chambers 52 are connected to the common flow channel 55 through the corresponding supply flow channels 54. By this means, the ink inside the common flow channel 55 is distributed and supplied to the pressure chambers 52.

A supply port 90 for supplying the ink to the common flow channel 55 is formed in the common flow channel forming member 68, and the ink is supplied to the common flow channel 55 from an ink tank 92 through the supply port 90. A pump 94 is connected to the ink tank 92. The driving of the pump 94 is controlled by a control device 96, in such a manner that the ink pressure (back pressure) inside the recording head 50 becomes a prescribed pressure. The ink tank 92 is equivalent to the ink storing and loading unit 14 shown in FIG. 1.

In the present embodiment, the common flow channel 55 is not disposed on the same side of the pressure chambers 52 as the side where the nozzles 51 are formed (in other words, the side adjacent to the nozzle plate 62), but rather is disposed on the side opposite same (in other words, on the side adjacent to the diaphragm 66, which forms the wall surface opposing the nozzle plate 62). Therefore, it is possible to compose the supply flow channels 54, which connect the pressure chambers 52 with the common flow channel 55, in a straight shape having a short flow channel length. Accordingly, the refilling performance is improved, and it is possible to eject ink at high frequency and to eject ink of high viscosity.

Piezoelectric elements 58 are arranged on the diaphragm 66 (on the side of the diaphragm 66 reverse to the side adjacent to the pressure chambers 52) at positions corresponding to the pressure chambers 52, in other words, at positions facing the pressure chambers 52 across the diaphragm 66. An individual electrode 57 is formed on the upper surface of each piezoelectric element 58. In the present embodiment, the diaphragm 66 also serves as a common electrode for the piezoelectric elements 58. The piezoelectric element 58 is covered with a protective cover 74, thereby achieving insulation and protection with respect to the ink inside the common flow channel 55.

By means of this composition, when a prescribed drive signal is supplied to the piezoelectric element 58 (individual electrode 57) from a drive circuit (not illustrated), in a state where ink has been filled in the pressure chambers 52, then due to the deformation of the diaphragm 66 caused by the displacement of the piezoelectric element 58, the ink inside the corresponding pressure chamber 52 is pressurized and a droplet of the ink is ejected from the nozzle 51 connected to that pressure chamber 52. After ejection of ink, when the supply of the drive signal is released, the diaphragm 66 reverts to its original state, and ink is supplied from the common flow channel 55 to the pressure chamber 52. In this way, the pressure chamber is prepared for the next ink ejection operation.

In the recording head 50 according to the present embodiment, a spacer member 70 and a nozzle protection member 72 are disposed on the nozzle surface 60A of the head main body 60, a space section 80 is provided on the ink ejection side of the nozzle 51, and furthermore, an ink transmission hole 82 for allowing an ink droplet ejected from the nozzle 51 to pass is formed in the nozzle protection member 72 at a position facing the nozzle 51 across the space section 80. Below, this composition of the periphery of the nozzle 51 is described in further detail with reference to FIG. 4.

Figure 4:
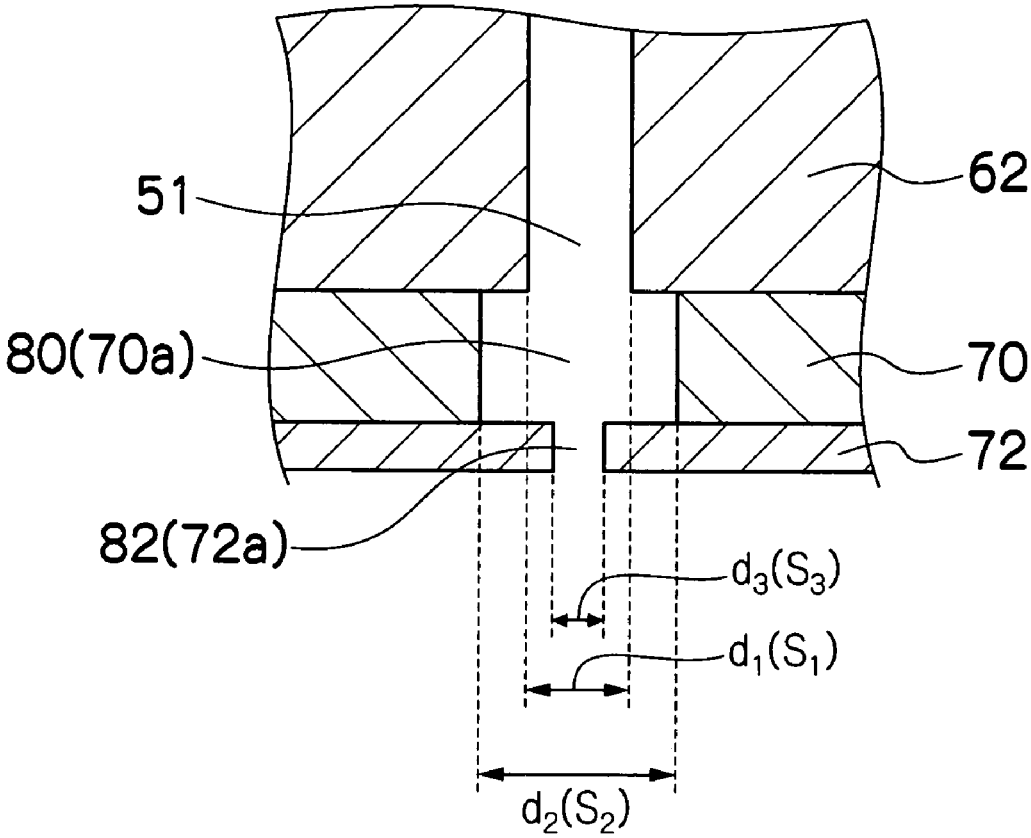
FIG. 4 is an enlarged cross-sectional diagram of the peripheral region of a nozzle in the recoding head.

FIG. 4 is an enlarged cross-sectional diagram of the periphery of the nozzle 51. As shown in FIG. 4, a large hole section 70*a* having a circular cylindrical shape (a straight cross-sectional shape) corresponding to the space section 80 is formed in the spacer member 70, and furthermore, a small hole section 72*a* having a circular cylindrical shape (a straight cross-sectional shape) corresponding to the ink transmission hole 82 is formed in the nozzle protection member 72. These hole sections 70*a* and 72*a* are formed respectively at positions corresponding to the nozzles 51, and the hole sections 70*a* and 72*a* are arranged in a substantially coaxial alignment with the corresponding nozzle 51. The spacer member 70 and the nozzle protection member 72 may be constituted integrally of one member, or they may be constituted of three or more separate members. A mode where these elements are formed from the same member is desirable, compared to a mode where they are formed from different members, since the coefficient of linear expansion is uniform and therefore axial divergence due to temperature change is not liable to arise.

In the present embodiment, the space section 80 and the ink transmission hole 82 are formed in such a manner that the diameter $d_1$ of the opening of the nozzle 51 (the nozzle diameter), the internal diameter $d_2$ of the space section 80, and the internal diameter $d_3$ of the ink transmission hole 82 have the relationships of $d_1<d_2$ and $d_3<d_2$, and more desirably $d_3<d_1<d_2$.

In other words, the space section 80 and the ink transmission hole 82 are formed in such a manner that the cross-sectional area 51 of the opening of the nozzle 51 parallel to the nozzle surface 60A (the opening surface area of the nozzle 51), the cross-sectional area $S_2$ of the space section 80 parallel to the nozzle surface 60A, and the cross-sectional area $S_3$ of the ink transmission hole 82 parallel to the nozzle surface 60A have the relationships of $S_1<S_2$ and $S_3<S_2$, and more desirably $S_3<S_1<S_2$.

The hole diameter $d_3$ of the ink transmission hole 82 must be greater than the diameter of the ink droplet ejected from the nozzle 51 so that the ink droplet is able to pass through the ink transmission hole 82 without making contact with the inner walls of the ink transmission hole 82.

Moreover, in order to compose the recording head 50 according to the present embodiment so as to minimize the overall head dimensions as far as possible by arranging the plurality of nozzles 51 in a two-dimensional configuration to form a matrix head and positioning the pressure chambers at high density, it is desirable that the cross-sectional area $S_2$ of the space section 80 and the cross-sectional area $S_4$ of the pressure chamber 52 parallel to the nozzle surface 60A have the relationship of $S_2<S_4$.

Thus, the space sections 80 are arranged respectively on the ink ejection sides of the nozzles 51, and the ink transmission holes 82 are also arranged oppositely to the nozzles 51 across the space sections 80. Hence, the flow of air in the vicinity of the nozzles 51 is restricted, and it is possible to suppress evaporation of the ink solvent inside the nozzles 51, and ejection defects caused by increased viscosity of the ink can be prevented. Therefore, when recording is restarted, it is possible to achieve normal ejection without performing preliminary ejection, and hence it is possible to reduce wasteful consumption of ink and to lower running costs.

In particular, in a case where the internal diameter $d_3$ of the ink transmission hole 82 is not only smaller than the internal diameter $d_2$ of the space section 80, but is also smaller than the internal diameter $d_1$ of the opening of the nozzle 51 (i.e., in the case where $d_3<d_1<d_2$), then the space section 80 more closely approaches a sealed state, and the space section 80 readily assumes a state saturated with the evaporated ink solvent and hence the progress of ink solvent evaporation inside the nozzle 51 can be suppressed reliably.

Moreover, it is possible to carry out ink ejection (in other words, image recording) and to prevent increase in viscosity of the ink in a state where the members constituting the space sections 80 and the ink transmission holes 82 (i.e., the spacer member 70 and the nozzle protection member 72) are disposed on the nozzle surface 60A rather being separated from the nozzle surface 60A. Therefore, no mechanism is required for moving all or a portion of these constituent members, and it is possible to reduce the size and the cost of the apparatus. Further, since no movement mechanism of this kind is provided, then it is possible to reduce the thickness of the recording head 50, while avoiding operational defects and thus making it possible to improve the reliability. Furthermore, since there is no time loss relating to the movement of the constituent members, then even in the case of using an ink which is liable to reach a state of increased viscosity in a short period of time, it is still possible to rapidly suppress the progress of ink solvent evaporation inside the nozzles 51, and hence ejection defects caused by increased viscosity of the ink can be prevented reliably.

Further, since the spacer member 70 and the nozzle protection member 72 are fixed to the nozzle surface 60A of the head main body 60, then it is possible to protect the nozzle surface 60A from contact or impacts with the recording medium or cleaning members, and from the adherence of foreign matter (dirt, dust, ink droplets, or the like). Even supposing that foreign matter does adhere to the nozzle protection member 72, the cleaning of the nozzle protection member 72 has no effect on the ejection characteristics of the nozzles 51, and therefore no problems occur even if excess cleaning is carried out (using, for example, increased wiping frequency and contact pressure) on the nozzle protection member 72.

Furthermore, it is preferable that the spacer member 70 disposed between the nozzle plate 62 and the nozzle protection member 72 is made of a resin heat insulating material (such as polycarbonate, acrylic resin, polyethyleneterephthalate (PET), or the like), then it is possible to insulate the heat generated externally of the head (for example, the heat generated by the decurling unit 20, and the like), and the evaporation of ink inside the nozzles 51 can therefore be restricted.

The above-described embodiment concerns the space section 80 and the ink transmission hole 82 formed in the round cylindrical shape (having the straight cross-section), but the implementation of the present invention is not limited to a composition of this kind, and it is also possible for these elements to have a polygonal cylindrical shape or an elliptical cylindrical shape, for example. In this case, taking account of the entrapment of bubbles, it is desirable to adopt a round circular shape which has fewer corners. Moreover, the ink transmission hole 82 may be formed in a counterbored shape in which the opening is wider on the ink ejection side, as shown in FIG. 5A, or it may be formed in a tapered shape gradually narrowing towards the ink ejection side, as shown in FIG. 5B.

Figure 5A:
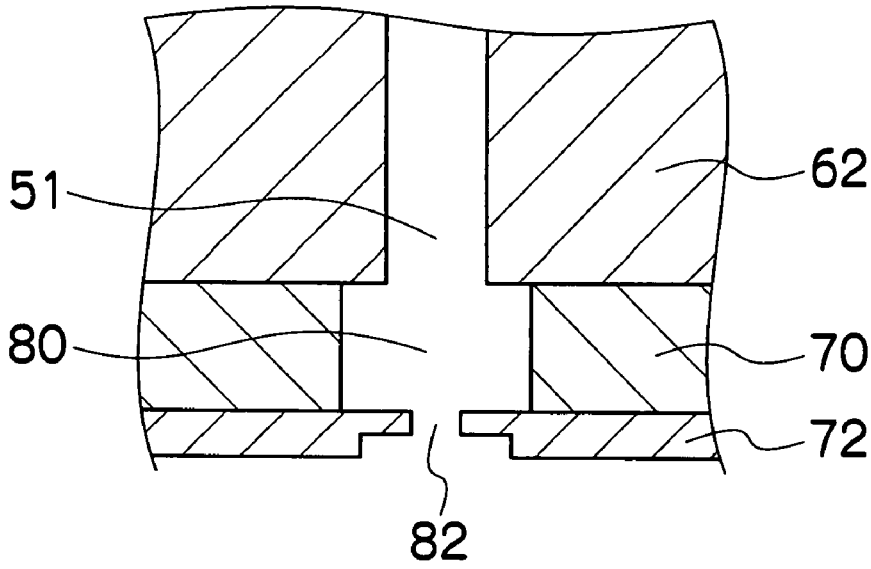
FIGS. 5A and 5B are diagram showing other shapes of an ink transmission hole.

The merit of adopting the mode where the ink transmission hole 82 has the counterbored shape on the ink ejection side as shown in FIG. 5A is that, if the ink transmission hole 82 is provided with no counterbore on the ink ejection side, for example, then the edges of the recording paper may catch on the ink transmission hole 82, and paper dust, or the like, may be left on the ink transmission hole 82, and this can cause problems where the ink droplet ejected from the nozzle 51 is not able to exit through the ink transmission hole 82, but if the ink transmission hole 82 is provided with the counterbore as shown in FIG. 5A, then paper dust and the like does not remain on the ink transmission hole 82 and it is possible to prevent the occurrence of problems such as those described above.

Figure 5B:
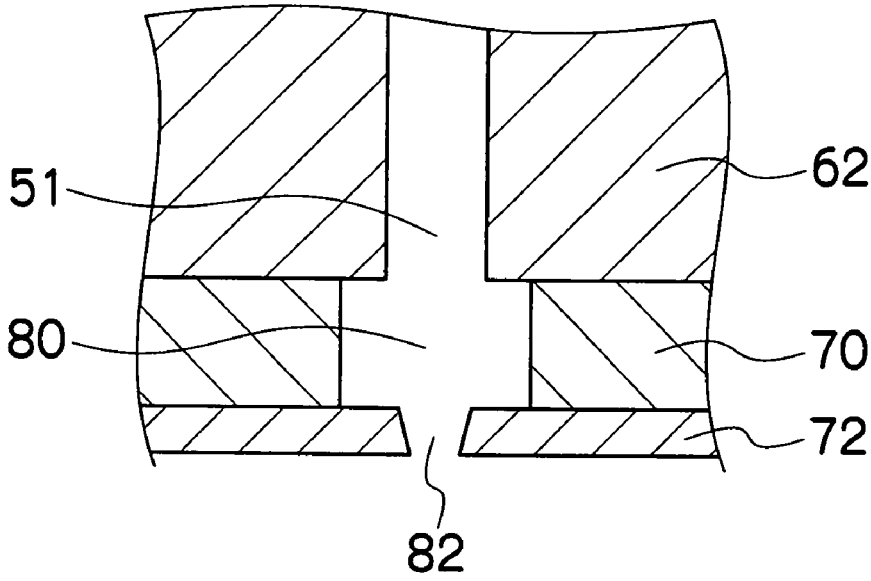

On the other hand, adopting the mode where the ink transmission hole 82 has the tapered shape as shown in FIG. 5B has beneficial effects in that, if the flight direction of the ink droplet exiting from the nozzle 51 is slightly displaced (if the direction of flight is slightly skewed), then the direction is changed by the tapered portion of the ink transmission hole 82 when the ink droplet exits through the ink transmission hole 82.

In the present embodiment, it is desirable that control is implemented in order to change the position of the free surface of the ink (the liquid-atmosphere interface, which is also commonly called "meniscus") inside the nozzle in accordance with the operational state (recording state/non-recording state) of the recording head 50. This control method is described in specific terms below.

Figure 6A:
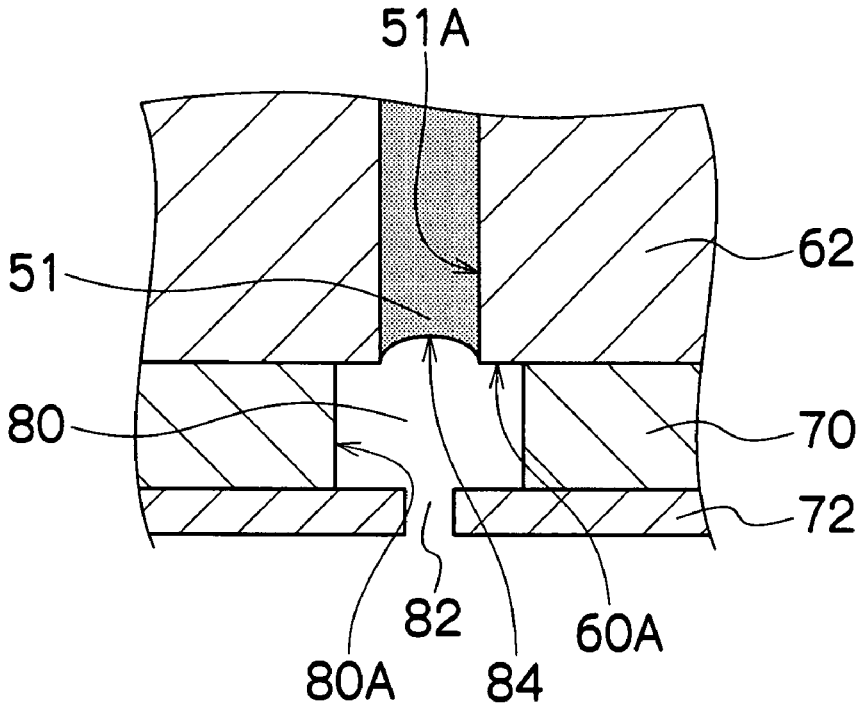
FIGS. 6A and 6B are enlarged cross-sectional diagrams of the peripheral region of the nozzle.
Figure 6B:
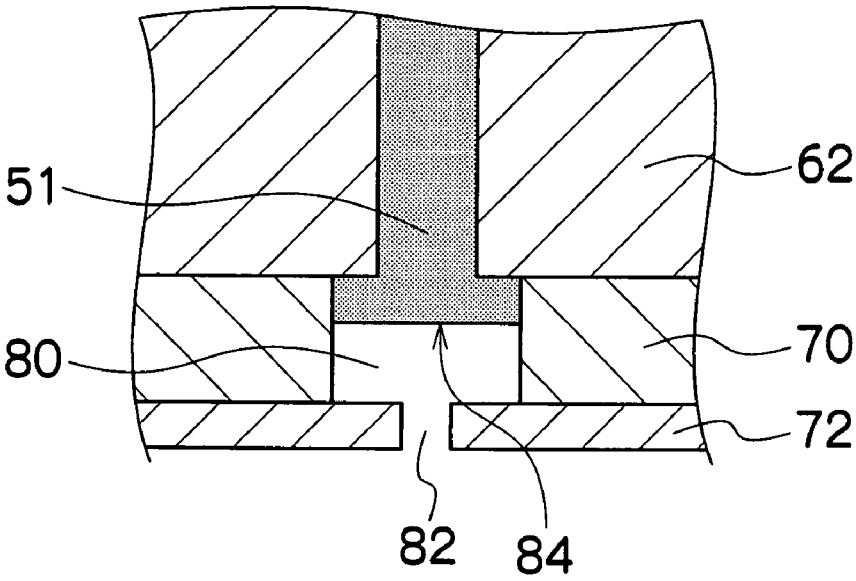

FIGS. 6A and 6B are enlarged cross-sectional diagrams of the peripheral region of the nozzle, in which FIG. 6A shows a case where the recording head 50 is in the recording state (recording mode) and FIG. 6B shows a case where the recording head 50 is not in the recording state (non-recording mode). If the recording head 50 is in the recording state, then as shown in FIG. 6A, the ink surface 84 is controlled so as to assume a position nearby the opening of the nozzle 51, thereby achieving a state where an ink droplet can be ejected from the nozzle 51. On the other hand, if the recording head 50 is in the non-recording state, then as shown in FIG. 6B, the ink surface 84 is controlled so as to assume a position between the nozzle 51 and the ink transmission hole 82, in other words, a position in the space section 80. The method for controlling the position of the ink surface 84 is, for example, a method which changes the internal pressure (back pressure) of the ink in the recording head 50. In the present embodiment, the back pressure in the recording head 50 is set to a prescribed pressure by controlling the driving of the pump 94 by means of the control device 96 shown in FIG. 2.

If the recording head 50 is in the non-recording state, then by moving the position of the ink surface 84 into the space section 80, it is possible to increase the area of the ink surface 84 and reduce the volume of the space section 80, so that the space section 80 can be made to assume a state saturated with the evaporated ink solvent in a short period of time, and the progress of ink solvent evaporation can be suppressed rapidly. Moreover, if the position of the ink surface 84 is moved to the space section 80, then although evaporation of the ink solvent occurs through the ink transmission hole 82, when the recording head 50 switches to the recording state and the ink surface 84 is retracted to the position nearby the opening of the nozzle 51, then agitation of the ink occurs and therefore it is possible to perform ejection normally when recording is restarted, without having to carry out a preliminary ejection. Consequently, wasteful consumption of ink is reduced and running costs can be lowered.

Figure 7:
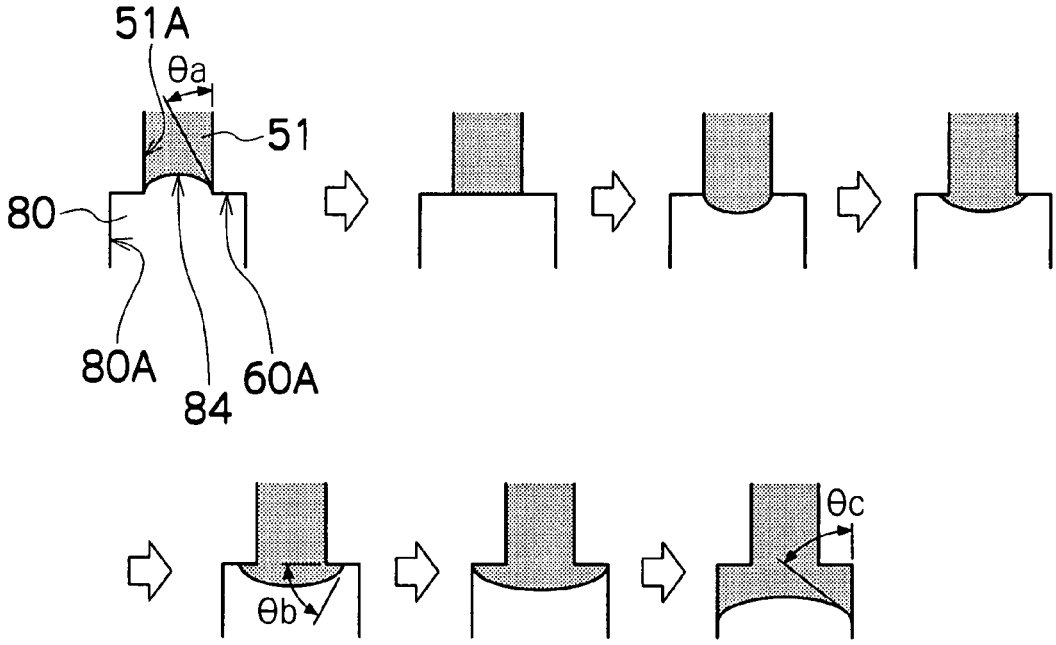
FIG. 7 is a diagram for describing an aspect of the change in the position of the ink surface.

FIG. 7 shows one example of the aspect of change in the position of the ink surface 84. If the control is implemented in order to change the position of the ink surface 84, it is desirable that the peripheral region of the nozzle 51 has a surface treatment of the following kind. More specifically, as shown in FIG. 7, the peripheral region of the nozzle 51 has a surface treatment in such a manner that, the contact angle $\theta a$ of the ink with respect to the inner wall 51A of the nozzle 51, the contact angle $\theta b$ of the ink with respect to the nozzle surface 60A, and the contact angle $\theta c$ of the ink with respect to the side wall 80A of the space section 80 have the relationships of $\theta a<\theta b\approx\theta c<90°$. Thus, it is possible to achieve stable ejection while preventing the ink inside the nozzles 51 from leaking out onto the nozzle surface 60A when the recording head 50 is in the recording state, and furthermore, it is possible to make the position of the ink surface 84 move smoothly.

In the case where the position of the ink surface is thus changed in accordance with the operational state of the recording head 50, if the ink surface 84 is formed in the ink transmission hole 82 due to a problem of some kind, the back pressure in the recording head 50 is reduced significantly to make the ink surface 84 return to the upstream side (pressure chamber 52 side) of the nozzle 51, and the ink is then filled again until the ink surface 84 reaches the vicinity of the opening of the nozzle 51.

Moreover, it is desirable that at least one of the humidity of the exterior of the recording head 50 and the humidity of the space section 80 is controlled in such a manner that the humidity of the exterior of the recording head 50 and the humidity of the space section 80 are substantially the same. It is thereby possible to reduce the amount of ink solvent evaporating when the ink surface 84 is moved to the space section 80 in the non-recording state of the recording head 50, even if the ink solvent evaporation occurs through the ink transmission hole 82 as described above.

Furthermore, if solidification of the ink occurs in the vicinity of the nozzle 51, then solvent (alcohol or an ink solvent component, or the like) may be introduced through the ink transmission hole 82, thereby dissolving the solidified ink.

A method for specifying the width dimension and the height dimension of the space section 80 is described. The width dimension of the space section 80 means the size of the space section 80 in the direction parallel to the nozzle surface 60A, and the height dimension of the space section 80 means the size of the space section 80 in the direction perpendicular to the nozzle surface 60A (in other words, in the direction of ejection of ink).

Firstly, the method of specifying the width dimension of the space section 80 is described. Here, the surface of the opening of the nozzle 51 (nozzle surface 60A) has a liquid-repelling treatment, the diameter of the opening of the nozzle 51 (nozzle diameter) is $d_1$, the surface tension of the ink is T, the density of the ink is D, and the gravitational acceleration is g (=9.8 m/s$^2$). When an ink droplet of the radius r drops from the nozzle 51 in free fall, the surface tension in the nozzle 51 ($=d_1\pi T$) and the gravitational force ($=4\pi r^3 Dg)/3$) balance with each other, and the radius r of the ink droplet is then given as $r=(3d_1T/4Dg)^{1/3}$. Hence, if the surface tension T of the ink droplet is 30 mN/mm, the density D of the ink is 1000 kg/m$^3$ and the nozzle diameter $d_1$ is 15 μm to 30 μm, then the diameter of the falling ink droplet becomes 0.65 mm to 0.82 mm. Consequently, the minimum value of the distance from the central axis of the nozzle 51 to the side wall 80A of the space section 80 must be at least approximately 0.5 mm.

Next, the method of specifying the height dimension of the space section 80 is described. When an ink droplet is ejected from the nozzle 51, a tail arises behind the main droplet, and this tail severs from the main droplet. In this case, the ink of the severed tail portion is pulled back toward the ink surface. In order that this ink tail is pulled back stably without being affected by external disturbances from the exterior of the ink transmission hole 82 (for example, the flow of air caused by the passage of the recording medium, or the like), it is desirable that the main droplet passes through the ink transmission hole 82 after the tail has severed from the main droplet. The severing of the tail is determined principally by the size of the ink droplet, the surface tension of the ink, the viscosity of the ink, and the speed of the ink droplet. In the case of a main droplet having the size of several picoliters (pl), the surface tension of 25 mN/mm to 35 mN/mm, the viscosity of 2 mPa·s to 10 mPa·s, and the speed of 6 m/s to 10 m/s, then in nearly all cases, severance of the tail occurs at 300 μm to 400 μm from the opening of the nozzle 51. Moreover, the throw distance in the present embodiment is the distance from the opening of the nozzle 51 to the recording medium, and therefore if the height of the space section 80 is great, then the throw distance becomes larger and the deposition accuracy of the ink droplet on the recording medium becomes lower. In general, the throw distance is often set to approximately 1 mm, and taking account of the risk of errors in the conveyance of the recording medium, the height of the space section 80 is desirably not greater than approximately 0.5 mm. On the other hand, the lower limit of the height dimension of the space section 80 should be such that a prescribed space is formed between the opening of the nozzle 51 and the ink transmission hole 82, and from the perspective of manufacturability, it is set to approximately 0.1 mm or above. From the foregoing, the height dimension of the space section 80 is preferably within the range of 0.3 mm to 0.5 mm.

In the method of manufacturing the recording head 50 according to the present embodiment, firstly, the laminate members (62, 64, 66, 68) constituting the head main body 60, the spacer member 70 formed with the large hole sections 70*a* corresponding to the space sections 80, and the nozzle protection member 72 formed with the small hole sections 72*a* corresponding to the ink transmission holes 82 are separately manufactured. Thereupon, the head main body 60 is obtained by successively layering and bonding together the laminate members (62, 64, 66, 68), and furthermore, the spacer member 70 and the nozzle protection member 72 are successively layered on and bonded to the nozzle surface 60A of the head main body 60. The recording head 50 according to the present embodiment is thus manufactured, as shown in FIG. 2.

Figure 8A:
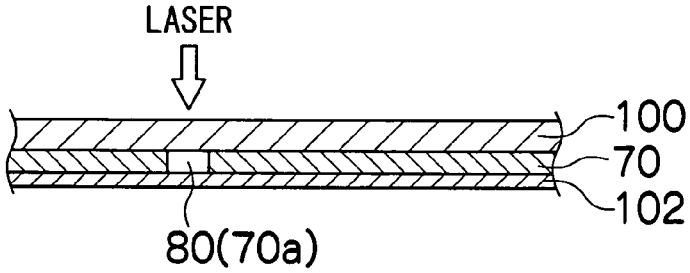
FIGS. 8A and 8B are diagrams for describing a manufacturing process when the nozzle and the ink transmission hole are formed in the same process.
Figure 8B:
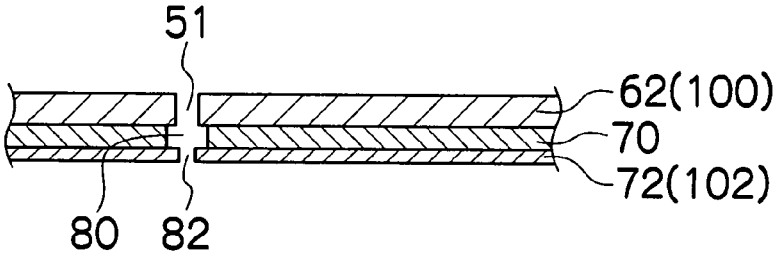

In the present method of manufacture, it is desirable that the nozzle 51 and the ink transmission hole 82 are formed in the same process. FIGS. 8A and 8B are diagrams showing a manufacturing process when the nozzle 51 and the ink transmission hole 82 are formed in the same process. Firstly, as shown in FIG. 8A, a first flat plate-shaped substrate 100, which corresponds to the nozzle plate 62, the spacer member 70 formed with the large hole section 70*a* corresponding to the space section 80, and a second flat plate-shaped substrate 102, which corresponds to the nozzle protection member 72, are layered and bonded together, in such a manner that the spacer member 70 is interposed between the first flat plate-shaped substrate 100 and the second flat plate-shaped substrate 102. Thereupon, laser processing is carried out at a prescribed position (a position where the space section 80 is formed) from the side of the first flat plate-shaped substrate 100. Consequently, as shown in FIG. 8B, it is possible to form the nozzle 51 and the ink transmission hole 82 with high accuracy in a substantially concentric fashion (to within a range of several micrometers). Thereupon, by successively layering and bonding the other laminate members (64, 66, 68) constituting the head main body 60, onto the laminated body of the nozzle plate 62, the spacer member 70 and the nozzle protection member 72, it is possible to obtain the recording head 50 according to the present embodiment. When the nozzle 51 and the ink transmission hole 82 are formed by the same process in this way, it is possible to reduce the burden of positional alignment tasks and to simplify the manufacturing process, in addition to which, stable ejection can be achieved by improving the positional accuracy.

Figure 9A:
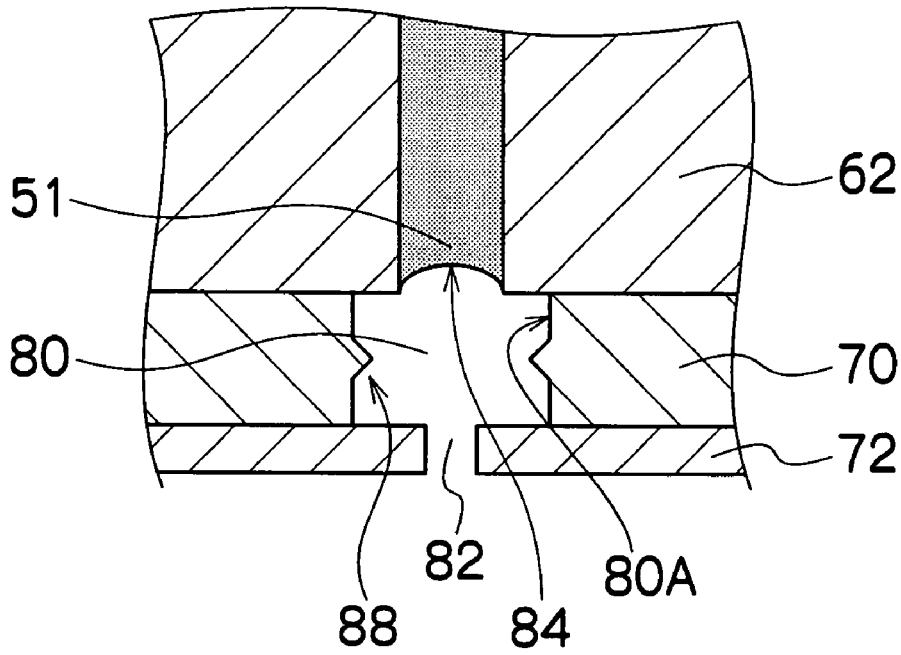
FIGS. 9A and 9B are diagrams showing a first modification of the first embodiment.
Figure 9B:
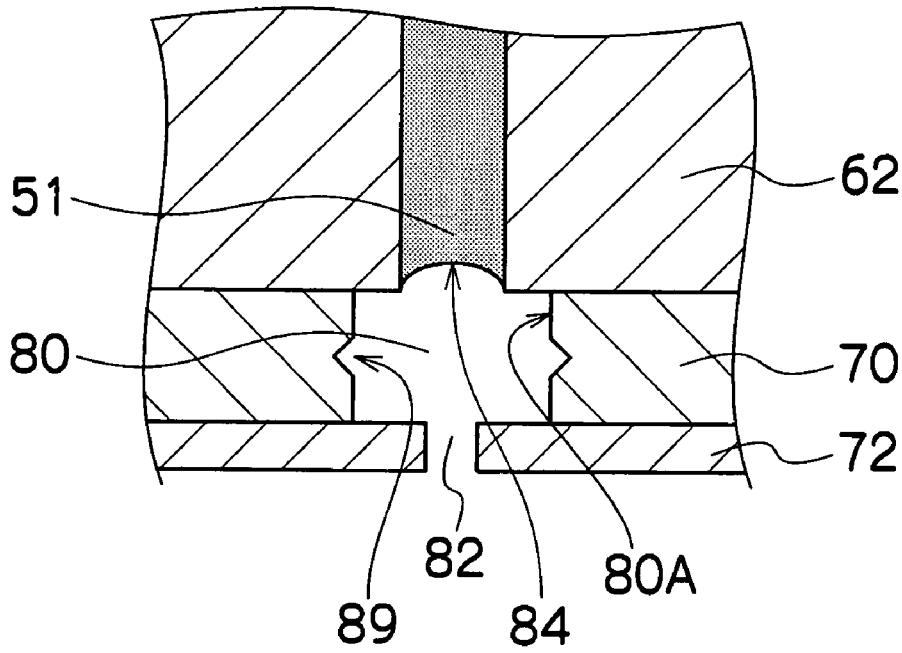

FIGS. 9A and 9B are diagrams showing a first modification of the first embodiment, in which FIG. 9A shows a case where a projecting section 88 is provided on the side wall 80A of the space section 80, and FIG. 9B shows a case where a groove section 89 is provided on the side wall 80A of the space section 80. Each of the projecting section 88 and the groove section 89 may be formed about the whole of the inner circumference of the space section 80 or in a portion of the inner circumference of the space section 80. By providing the projecting section 88 or the groove section 89 in the side wall 80A of the space section 80, it is possible to maintain the ink surface 84 in a stable state when the position of the ink surface 84 has been moved into the space section 80 while the recording head 50 is in the non-recording state.

Figure 10A:
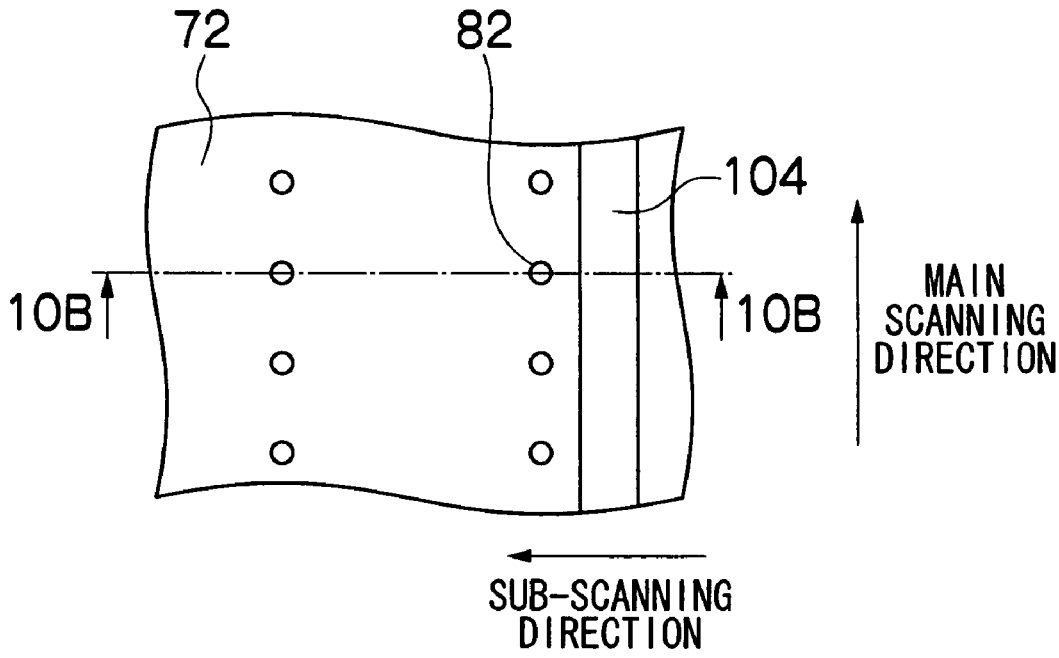
FIGS. 10A and 10B are diagrams showing a second modification of the first embodiment.
Figure 10B:
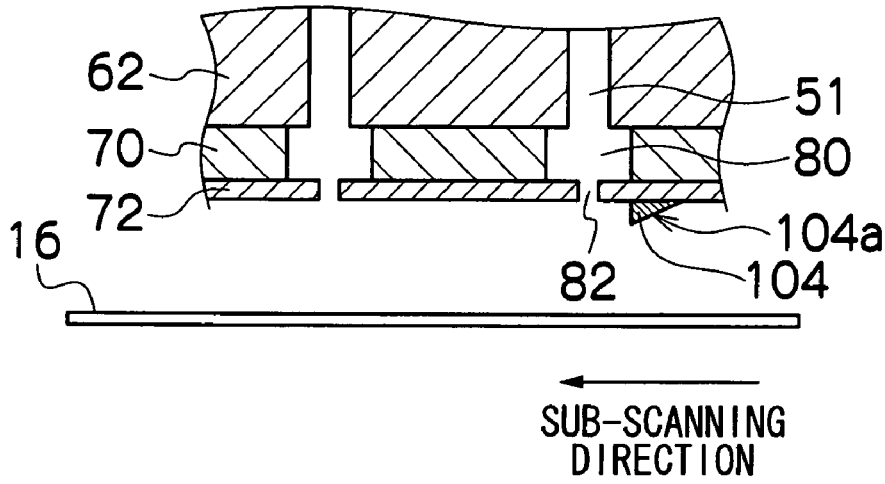

FIGS. 10A and 10B are diagrams showing a second modification of the first embodiment, in which FIG. 10A is a plan diagram showing a portion of the recording head 50 as viewed from the side of the nozzle protection member 72, and FIG. 10B is a cross-sectional diagram along line 10B-10B in FIG. 10A. As shown in FIGS. 10A and 10B, a projection-shaped conveyance guide 104 extending in the main scanning direction, which corresponds to the breadthways direction of the recording medium 16, is provided on the surface of the nozzle protection member 72 facing the recording paper 16, on the upstream side in the sub-scanning direction, which corresponds to the conveyance direction of the recording paper 16 (the paper conveyance direction). In order to prevent curling up of the recording paper 16, as shown in FIG. 10B, this conveyance guide 104 is formed so as to have a triangular cross-sectional shape having a surface 104A oblique with respect to the sub-scanning direction.

Figure 11A:
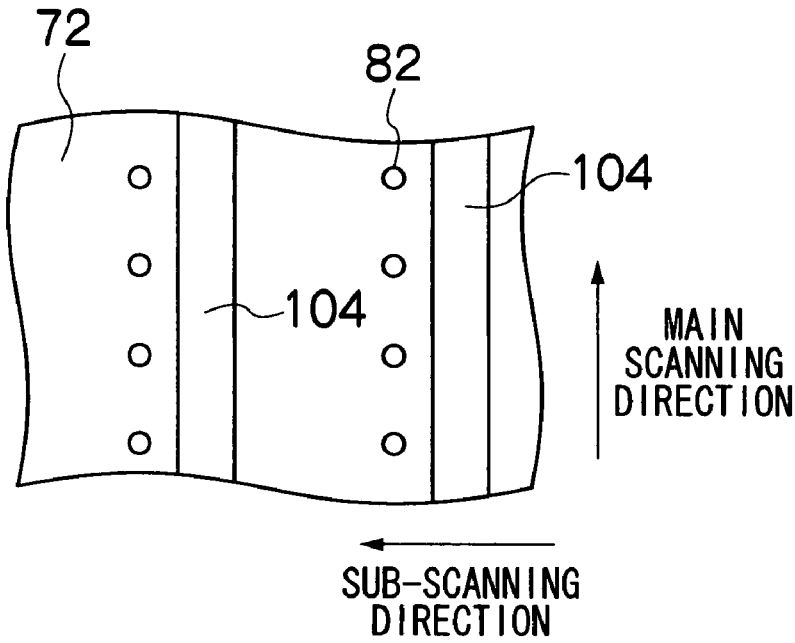
FIGS. 11A and 11B are diagrams showing a third modification of the first embodiment.
Figure 11B:
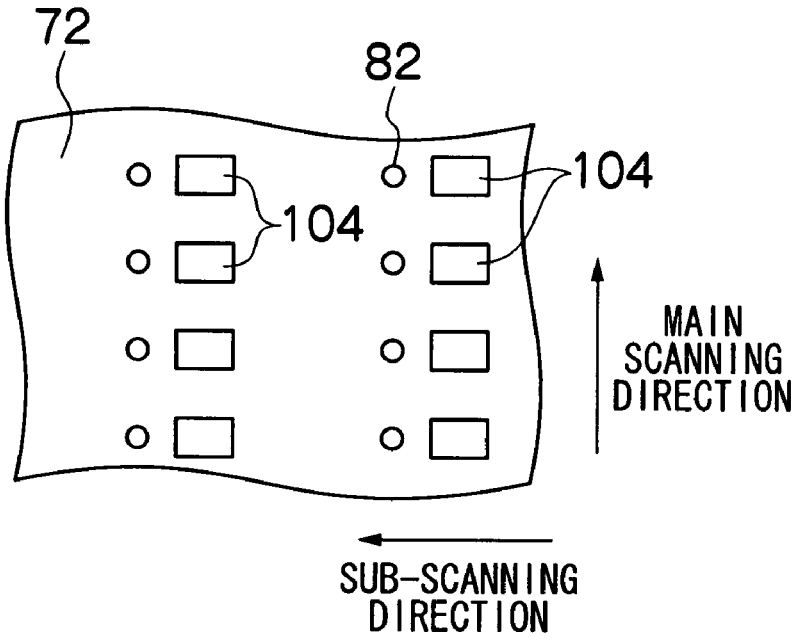

FIGS. 11A and 11B are diagrams showing a third modification of the first embodiment, in which FIG. 11A shows a case where the conveyance guide 104 is provided at each row of the ink transmission holes 82 aligned in the main scanning direction (i.e., for each row in the main scanning direction of the nozzles 51), and FIG. 11B shows a case where the conveyance guide 104 is provided for each of the ink transmission holes 82 (i.e., for each of the nozzles 51). In other words, the present modification relates to a case where the plurality of conveyance guides 104 are provided on the nozzle protection member 72.

By making the nozzle protection member 72 also serve as the conveyance guide as in the second and third modifications, it is possible to reduce the number of components and the costs.

Second Embodiment

Next, a second embodiment of the present invention is described. In the following description, the parts of the second embodiment that are common to the first embodiment detailed above are not described, and the explanation focuses on the characteristic features of the second embodiment.

Figure 12A:
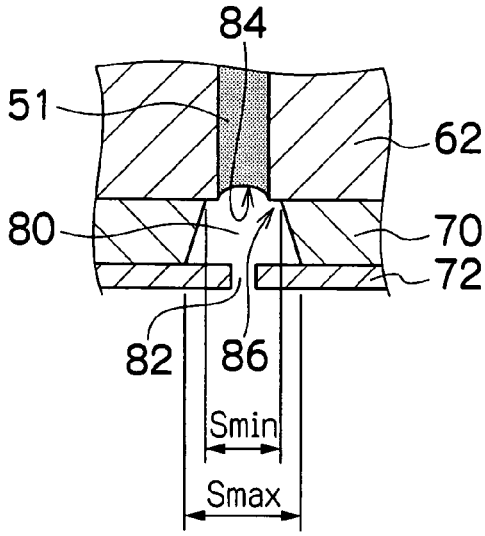
FIGS. 12A to 12D are enlarged cross-sectional diagrams showing the peripheral region of the nozzle according to a second embodiment of the present invention.
Figure 12C:
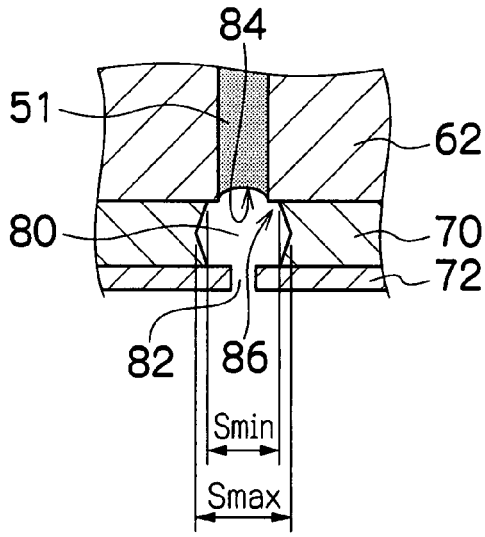
Figure 12B:
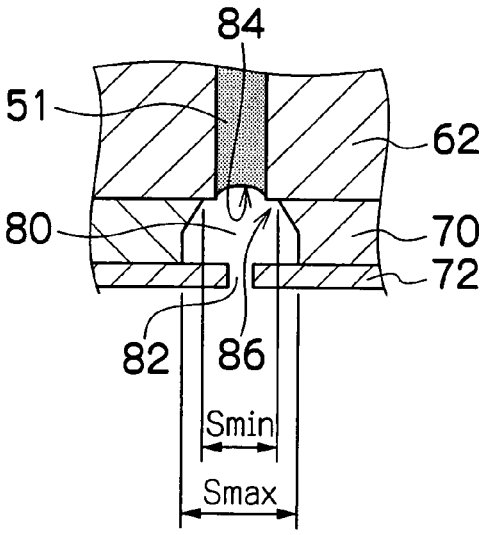
Figure 12D:
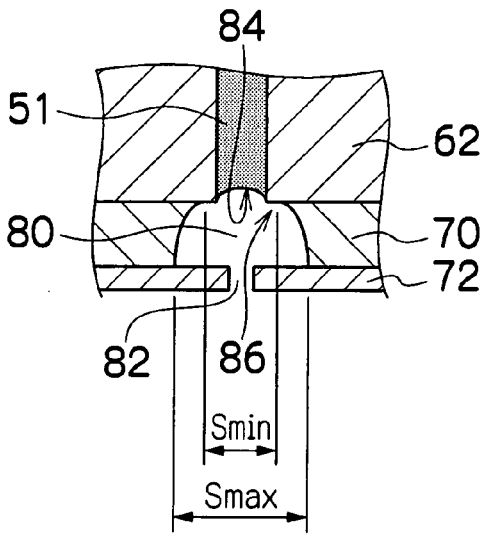

FIGS. 12A to 12D are enlarged cross-sectional diagrams showing the peripheral region of the nozzle 51 according to the second embodiment. In the cross-sectional compositions of the respective space sections 80 shown in FIGS. 12A to 12D, the space section 80 in FIG. 12A has a straightly-flared shape gradually broadening toward the ink ejection side, the space section 80 in FIG. 12B is constituted of a portion adjacent to the nozzle 51 having a flared shape and a portion adjacent to the ink transmission hole 82 having a cylindrical shape, the space section 80 in FIG. 12C is constituted of a portion adjacent to the nozzle 51 having a flared shape and a portion adjacent to the ink transmission hole 82 having a tapered shape, and the space section 80 in FIG. 12D has a curvedly-flared shape gradually broadens towards the ink ejection side. By forming at least the nozzle 51 side of the space section 80 so as to have the straightly or curvedly flared shape gradually broadening towards the ink ejection side, when the position of the ink surface 84 is changed from the ejection position to the space section 80, bubbles are less liable to remain in the corner section 86 of the space section 80 adjacent to the nozzle surface 60A, in comparison with the first embodiment. Consequently, when the position of the ink surface 84 is changed from the position within the space section 80 to the position nearby the opening of the nozzle 51, no bubbles are introduced and it is possible to prevent ejection defects caused by the introduction of bubbles.

With regards to the cross-sectional area parallel to the nozzle surface 60A (the cross-sectional area of the flow channel), the maximum cross-sectional area Smax in each of the space sections 80 shown in FIGS. 12A to 12D is formed so as to be smaller than the cross-sectional area of the pressure chamber, and the minimum cross-sectional area Smin is formed so as to be greater than the cross-sectional areas of the opening of the nozzle 51 and the ink transmission hole 82.

Figure 13A:
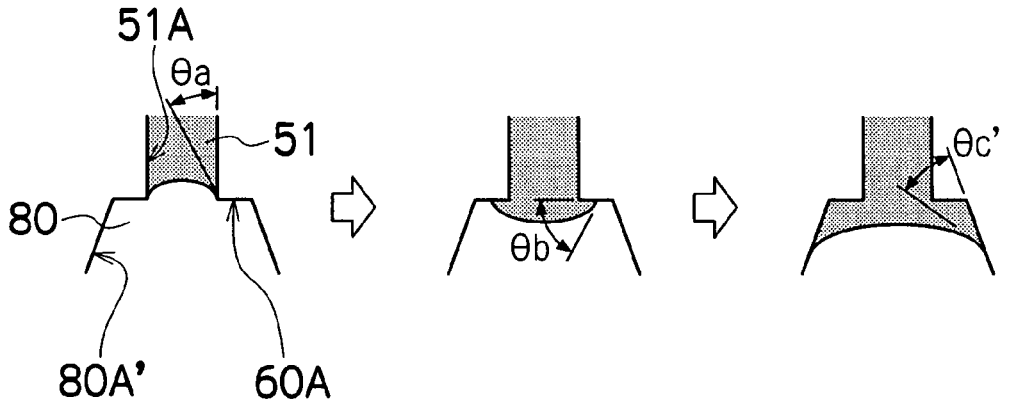
FIGS. 13A and 13B are diagrams for describing aspects of the change in the position of the ink surface.
Figure 13B:
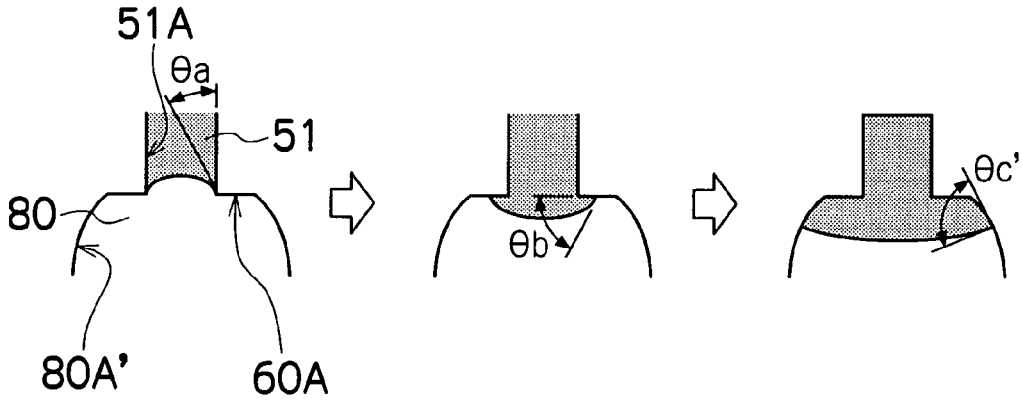
Figure 14A:
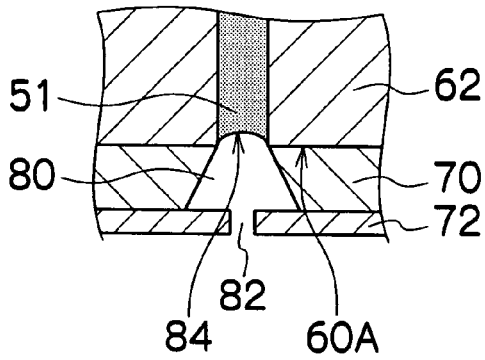
FIGS. 14A to 14D are enlarged cross-sectional diagrams showing the peripheral region of the nozzle according to a modification of the second embodiment.
Figure 14C:
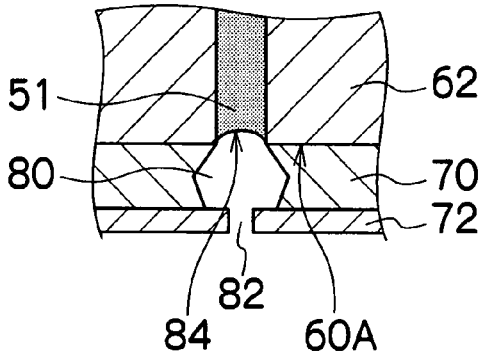
Figure 14B:
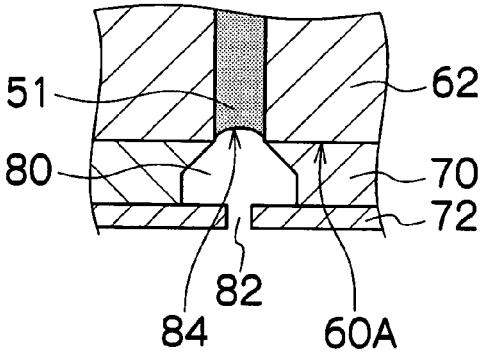
Figure 14D:
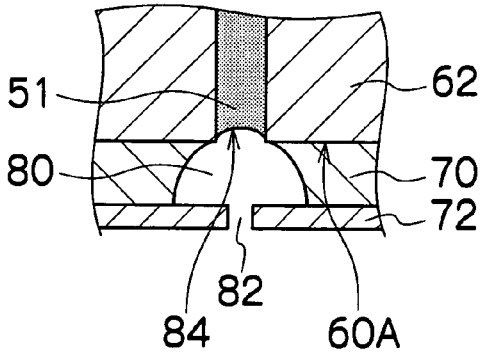

The surface treatment of the peripheral region of the nozzle 51 is substantially similar to the first embodiment. As shown in FIGS. 13A and 13B, the peripheral region of the nozzle 51 has a surface treatment in such a manner that, the contact angle $\theta a$ of the ink with respect to the inner wall 51A of the nozzle 51, the contact angle $\theta b$ of the ink with respect to the nozzle surface 60A, and the contact angle $\theta c'$ of the ink with respect to the side wall 80A' of the space section 80, which has the straightly or curvedly flared shape, have the relationships of $\theta a<\theta b\approx\theta c'<90°$. Thus, it is possible to achieve stable ejection while preventing the ink inside the nozzles 51 from leaking out into the space section 80 when the recording head 50 is in the recording state, and furthermore, it is possible to make the ink surface move smoothly and to prevent ejection defects caused by incorporation of air.

FIGS. 14A to 14D are enlarged cross-sectional diagrams showing the peripheral region of the nozzle 51 according to modifications of the second embodiment. FIGS. 14A to 14D correspond respectively to FIGS. 12A to 12D, and in all of these cases the nozzle surface 60A is not exposed inside the space section 80. By adopting a composition of this kind, no corner sections 86 (see FIGS. 12A to 12D) are formed in the space section 80 on the side defined with the nozzle surface 60A, and therefore it is possible more reliably to prevent ejection defects caused by incorporation of air.

Third Embodiment

Next, a third embodiment of the present invention is described. In the following description, the parts of the third embodiment that are common to the first and second embodiments detailed above are not described, and the explanation focuses on the characteristic features of the third embodiment.

Figure 15:
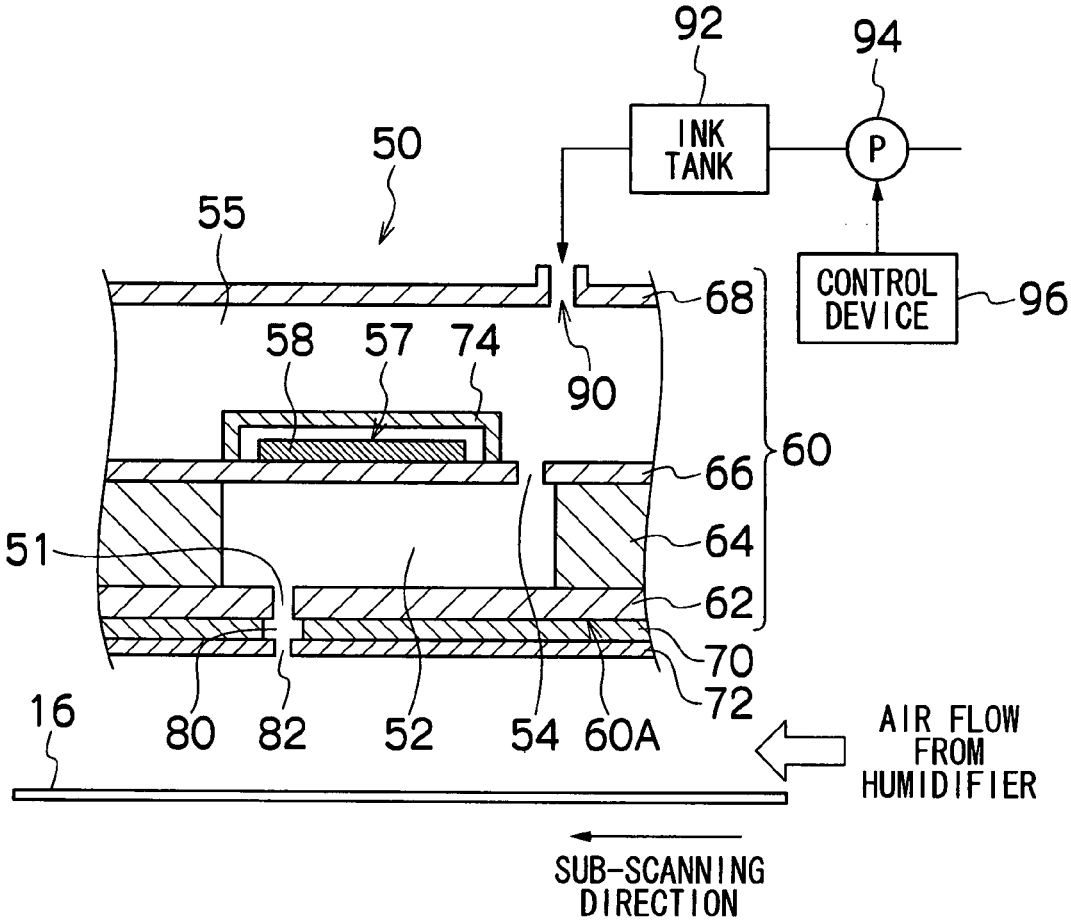
FIG. 15 is a diagram for describing a third embodiment of the present invention.

FIG. 15 is a diagram for describing the third embodiment. As shown in FIG. 15, the present embodiment uses the recording head 50 similar to that of the first embodiment, and is composed in such a manner that air that has been adjusted to a prescribed humidity by means of a humidifier (not shown) is supplied to the surface of the recording head 50 facing the recording paper 16, from the upstream side in terms of the sub-scanning direction.

Figure 16:
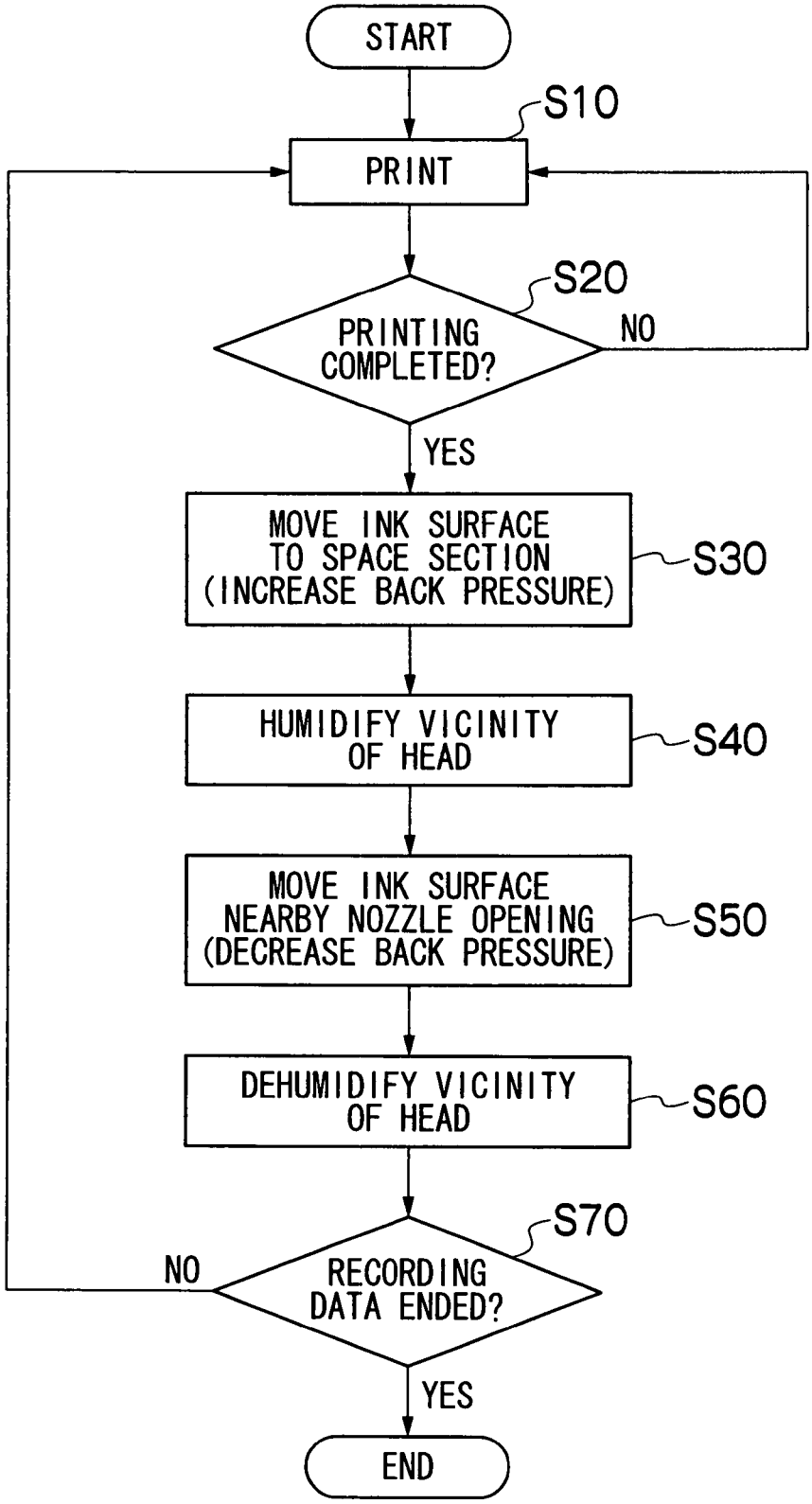
FIG. 16 is a flowchart showing a control procedure according to the third embodiment.

FIG. 16 is a flowchart showing a control procedure according to the third embodiment. Below, the respective processing steps are described with reference to this flowchart.

Firstly, when processing starts, a print operation by the recording head 50 (ejection operation from the nozzles 51) is carried out (step S110), and it is then judged whether or not the print operation has been completed (step S20). If the print operation has not been completed, the procedure returns to step S10 and the print operation is continued. If, on the other hand, the print operation has been completed, then the back pressure in the recording head 50 is raised to move the ink surface into the space section 80 (step S30). Then, the vicinity of the recording head 50 is humidified (step S40). After a prescribed period of time has elapsed, the back pressure in the recording head 50 is reduced (in other words, the back pressure is returned to its original state), thereby returning the ink surface to the vicinity of the opening of the nozzle 51 (step S50). Then, the vicinity of the recording head 50 is dehumidified (step S60). Thereafter, it is judged whether or not the recording data has ended (step S70). If the recording data has not ended, then the processing is repeated from step S10. If, on the other hand, the recording data has ended, then the processing is terminated.

In this way, in the third embodiment, after printing has been completed, in other words, when the recording head 50 has assumed the non-printing state, the ink surface is moved into the space section 80, and moreover, the vicinity of the recording head 50 is humidified, whereupon the ink surface is then returned to the vicinity of the opening of the nozzle 51. In this case, by controlling the air incorporated into the space section 80 from the exterior of the recording head 50 in such a manner that the incorporated air has substantially the same humidity as the air existing inside the space section 80, further continuation of the ink solvent evaporation is prevented after the ink surface has returned to the vicinity of the opening of the nozzle 51. Moreover, since the ink surface is located at the ejection position when recording is restarted, then it is possible to rapidly start the ejection operation from the nozzles 51, and therefore, there is no time loss until the start of recording. Furthermore, since the dual layered structure is adopted in which the space section 80 and the ink transmission hole 82 are provided on the ink ejection side of each nozzle 51, then it is possible to suppress the progress of the ink solvent evaporation by maintaining the interior of the space section 80 in the state saturated with the evaporated ink solvent, and therefore it is not necessary to constantly control the humidity. If the recording head does not have the dual layered structure of this kind, then constant control of the humidity is necessary, and the humidity control is instable and readily gives rise to problems of condensation. These problems can be avoided in the case of the present embodiment.

According to the above-described embodiments of the present invention, by providing the space section 80 on the ink ejection side of each nozzle 51, and by providing the ink transmission hole 82 at the position opposing each nozzle 51 across the space section 80, it is possible to protect the nozzle surface 60A and to prevent entry of foreign matter into the nozzles 51, as well as preventing ejection defects caused by increase in the viscosity of the ink and reducing wasteful consumption of ink. Moreover, it is possible to perform ink ejection and to prevent increase in viscosity in a state where the space sections 80 and the ink transmission holes 82 are still disposed on the ink ejection side of the nozzles 51, in other words, without having to separate the space member 70 and the nozzle protection member 72 from the main body of the head 60, and hence the objects can be achieved by means of a simple composition without needing to provide special mechanisms, thereby enabling both size reductions and cost reductions in the apparatus.

Furthermore, by changing the position of the ink surface in accordance with the operational state of the recording head 50, it is possible to rapidly suppress the progress of the ink solvent evaporation inside the nozzles 51, and even if the non-recording state continues for only a short period of time, or even if using the ink liable to increase in viscosity in a short period of time, it is still possible reliably to prevent ejection defects caused by increase in the viscosity of the ink, and hence wasteful consumption of ink due to preliminary ejection can be reduced.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a plurality of nozzles having openings through which liquid is ejected;

a plurality of pressure chambers which are connected to the nozzles, respectively;

a space section forming member which defines a plurality of space sections arranged adjacently to the openings of the nozzles, respectively; and a liquid transmission hole forming member which is formed with a plurality of liquid transmission holes in coaxial positions with respect to the nozzles so as to oppose the openings of the nozzles across the space sections, respectively, wherein in terms of cross-sectional areas parallel to a plane including the openings of the nozzles, each of the space sections is smaller than each of the pressure chambers, and larger than each of the openings of the nozzles and the liquid transmission holes.

2. The liquid ejection head as defined in claim 1, wherein in terms of the cross-sectional areas parallel to the plane including the openings of the nozzles, each of the liquid transmission holes is smaller than each of the openings of the nozzles.

3. A liquid ejection apparatus, comprising:

the liquid ejection head defined in claim 1; and a control device which changes a position of a free surface of the liquid at each of the nozzles in accordance with an operational state of the liquid ejection head.

4. The liquid ejection apparatus as defined in claim 3, wherein the control device sets the position of the free surface of the liquid to be a position within each of the space sections when the liquid ejection head is in a non-recording state, and sets the position of the free surface of the liquid to be a position nearby each of the openings of the nozzles when the liquid ejection head is in a recording state.

5. The liquid ejection apparatus as defined in claim 3, wherein a contact angle of the liquid with respect to an inner wall of each of the space sections is greater than a contact angle of the liquid with respect to an inner wall of each of the nozzles.

6. An image forming apparatus comprising the liquid ejection apparatus as defined in claim 3.

7. An image forming apparatus comprising the liquid ejection head as defined in claim 1.

* * * * *